United States Patent [19]

Schricker et al.

[11] Patent Number: 4,830,614

[45] Date of Patent: May 16, 1989

[54] ORAL HYGIENE WORK STATION

[75] Inventors: Hanns Schricker, Münster; Heinz-Dieter Bialy, Senden-Bösensell, both of Fed. Rep. of Germany

[73] Assignee: Kommanditgesellschaft Speiko Dr. Speier GmbH. & Co. NACHF., Münster, Fed. Rep. of Germany

[21] Appl. No.: 32,756

[22] PCT Filed: Apr. 2, 1986

[86] PCT No.: PCT/DE86/00140

§ 371 Date: Feb. 13, 1987

§ 102(e) Date: Feb. 13, 1987

[87] PCT Pub. No.: WO86/05974

PCT Pub. Date: Oct. 23, 1986

[30] Foreign Application Priority Data

Apr. 13, 1985 [DE] Fed. Rep. of Germany ..... 3513300

[51] Int. Cl.[4] ..... A61G 15/00

[52] U.S. Cl. ..... 433/79; 108/93; 108/94; 312/209; 312/326

[58] Field of Search ..... 433/77, 79; 312/209, 312/326; 108/93, 94; 384/452

[56] References Cited

U.S. PATENT DOCUMENTS

| | | | |
|---|---|---|---|
| 619,928 | 2/1899 | Bigelow | 433/77 X |
| 622,335 | 4/1899 | Eales et al. | 108/93 |
| 656,556 | 8/1900 | Lind | 433/77 X |
| 689,589 | 12/1901 | Hullhorst | 312/209 |
| 1,300,993 | 4/1919 | Miller | 108/93 |
| 2,227,786 | 10/1939 | La Fee | 108/93 |
| 2,612,424 | 9/1952 | Hochalter | 108/93 |
| 3,902,246 | 4/1972 | Wolf et al. | 433/77 |
| 3,922,788 | 12/1975 | Rota | 433/77 X |
| 4,377,379 | 3/1983 | Kawaguchi | 433/77 |
| 4,396,127 | 8/1983 | Gremert et al. | 212/233 |

FOREIGN PATENT DOCUMENTS

| | | | |
|---|---|---|---|
| 1766863 | 7/1968 | Fed. Rep. of Germany . | |
| 2404876 | 2/1974 | Fed. Rep. of Germany . | |
| 2753169 | 6/1978 | Fed. Rep. of Germany | 384/452 |
| 2177287 | 1/1973 | France . | |

OTHER PUBLICATIONS

Hamilton®, "American Modular", Dental Cabinets Catalog, ©1966.

*Primary Examiner*—Samuel Scott
*Assistant Examiner*—Allen J. Flanigan
*Attorney, Agent, or Firm*—Spencer & Frank

[57] ABSTRACT

An oral hygiene work station includes a work table which includes a wash basin and a spray fitting and at least one cabinet which can receive additional components. A table top is pivotally mounted underneath and approximately in the center of the work table. The table top is pivotally mounted between a first position where the table top is disposed between the work table and the cabinet and extends so that the table top faces away from the wash basin to a second position where the table top has pivoted approximately 90° so that the table top extends beyond the frontal edge surface of the work table and avoids interference with access to the cabinet.

13 Claims, 3 Drawing Sheets

ORAL HYGIENE WORK STATION

BACKGROUND OF THE INVENTION

1. Field of the Invention

The invention relates to an oral hygiene work station placed against a wall and including a work table in which is incorporated a wash basin equipped with a spray attachment and at least one base cabinet disposed on a base so as to accommodate additional elements.

There exsits oral hygiene work stations at which patients can be educated and which also allow prophylactic work to be done on the patient. In addition to the fixedly installed work table having a wash basin and a spray fitting, oral hygiene work stations include base cabinets or base-mounted structures equipped with compartments and/or drawers to accommodate additional elements, such as a periodontal spray and a video device.

2. Discussion of the Prior Art

Essentially two concepts are known for oral hygiene work stations. In one concept, the part of the work table including the wash basin is angled in the manner of the base of the letter L. In this concept, a patient and a dental assistant sit facing one another. Its advantage is that direct cooperation is possible between the dental assistant and the patient; and that additional elements can easily be integrated. The drawback of this concept is its rigidity and that it requires too much space. In the other concept, the work table is placed against a wall—generally a wall equipped with a mirror—in the manner of a rectangular console table. The dental assistant and the patient sit next to one another. An oral hygiene work station equipped in this manner also has the advantage that additional elements can easily be integrated. Its drawback is that only indirect cooperation is possible between the dental assistant and the patient.

SUMMARY OF THE INVENTION

It is the object of the invention to design an oral hygiene work station of the above-described type which combines the advantages of the prior art concepts without their drawbacks. This is accomplished according to the invention in that an additional table top is pivotally fastened below the work table, essentially in the center between its front faces. In its one end position, this additional table top is pivoted between the work table and the base cabinet at the frontal face of the work station which faces away from the frontal region equipped with the wash basin. In the other end position, the additional table top is pivoted out at a right angle to the work table.

The oral hygiene work station according to the invention can be used with the additional work table pivoted in or out. With the additional work table pivoted in, its space requirement is no more than for a rectangular console table. Nevertheless, the present invention allows the dental assistant and the patient to sit facing one another for direct cooperation since it is merely necessary to pivot out the additional work table. Additional elements, such as a periodontal spray and video device can be integrated in the same manner as in the prior art oral hygiene work stations.

BRIEF DESCRIPTION OF THE DRAWINGS

One embodiment of the invention is illustrated in the drawings and will be described in greater detail below. It is shown in:

FIG. 1 is a perspective view of an oral hygiene work station with the additional work table pivoted in;

DESCRIPTION OF THE PREFERRED EMBODIMENT

Figure 4:
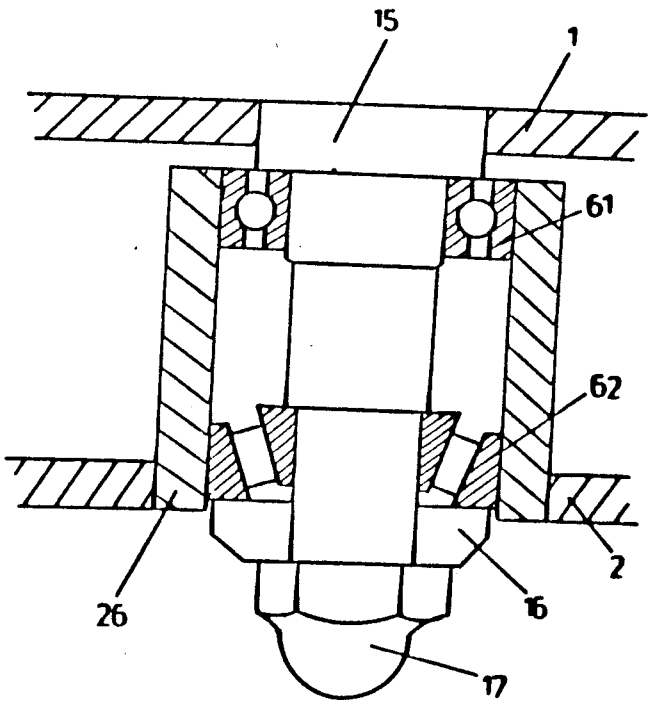
FIG. 4 is an sectional side elevational view of a swivel joint.
Figure 1:
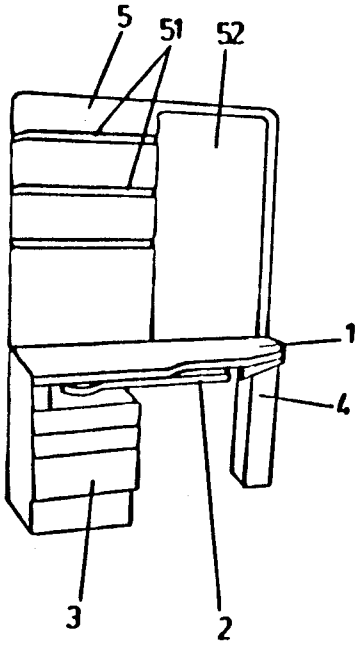
Figure 2:
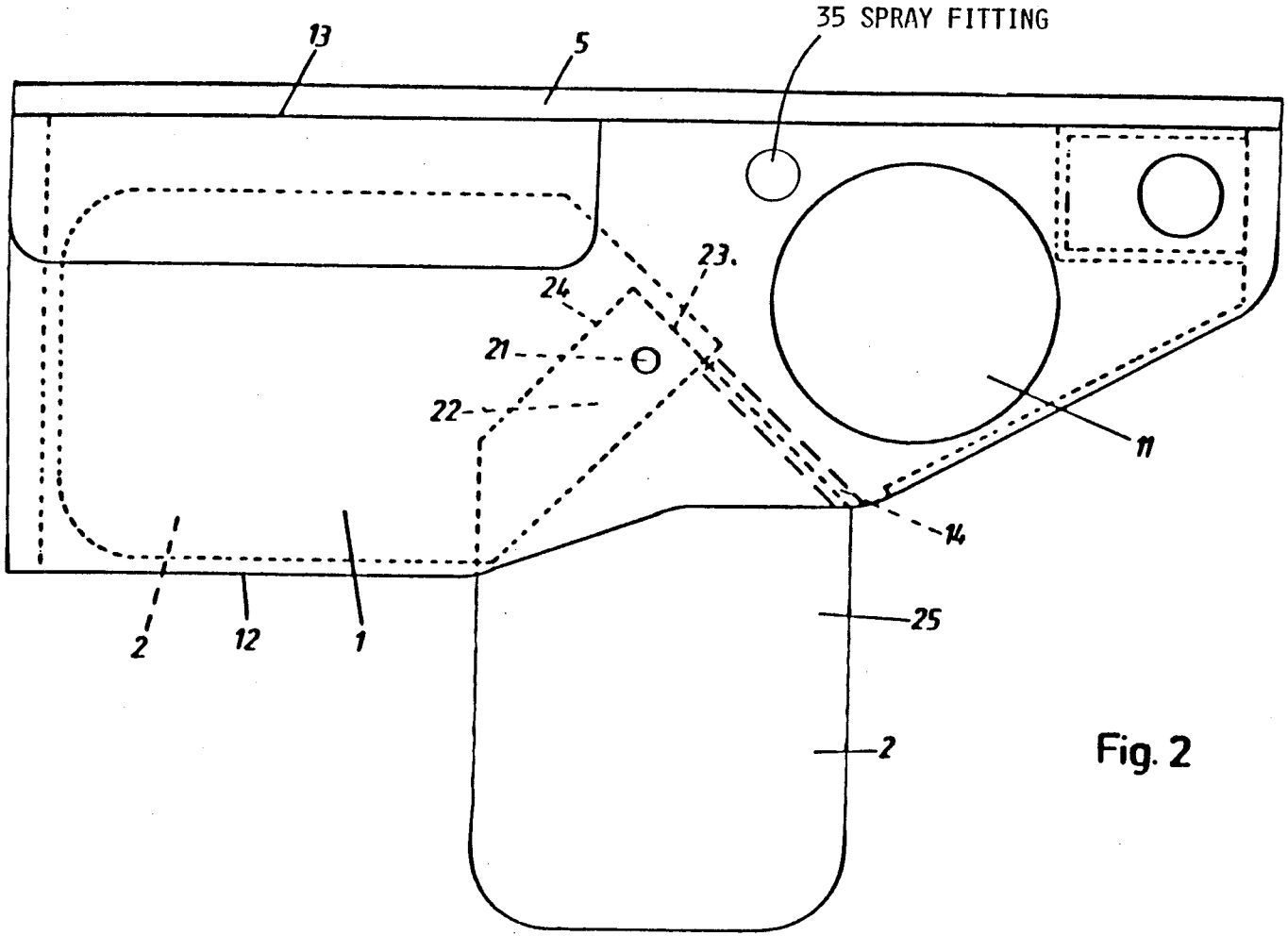
FIG. 2 is a top view of the oral hygiene work station with the additional work table pivoted out.
Figure 3:
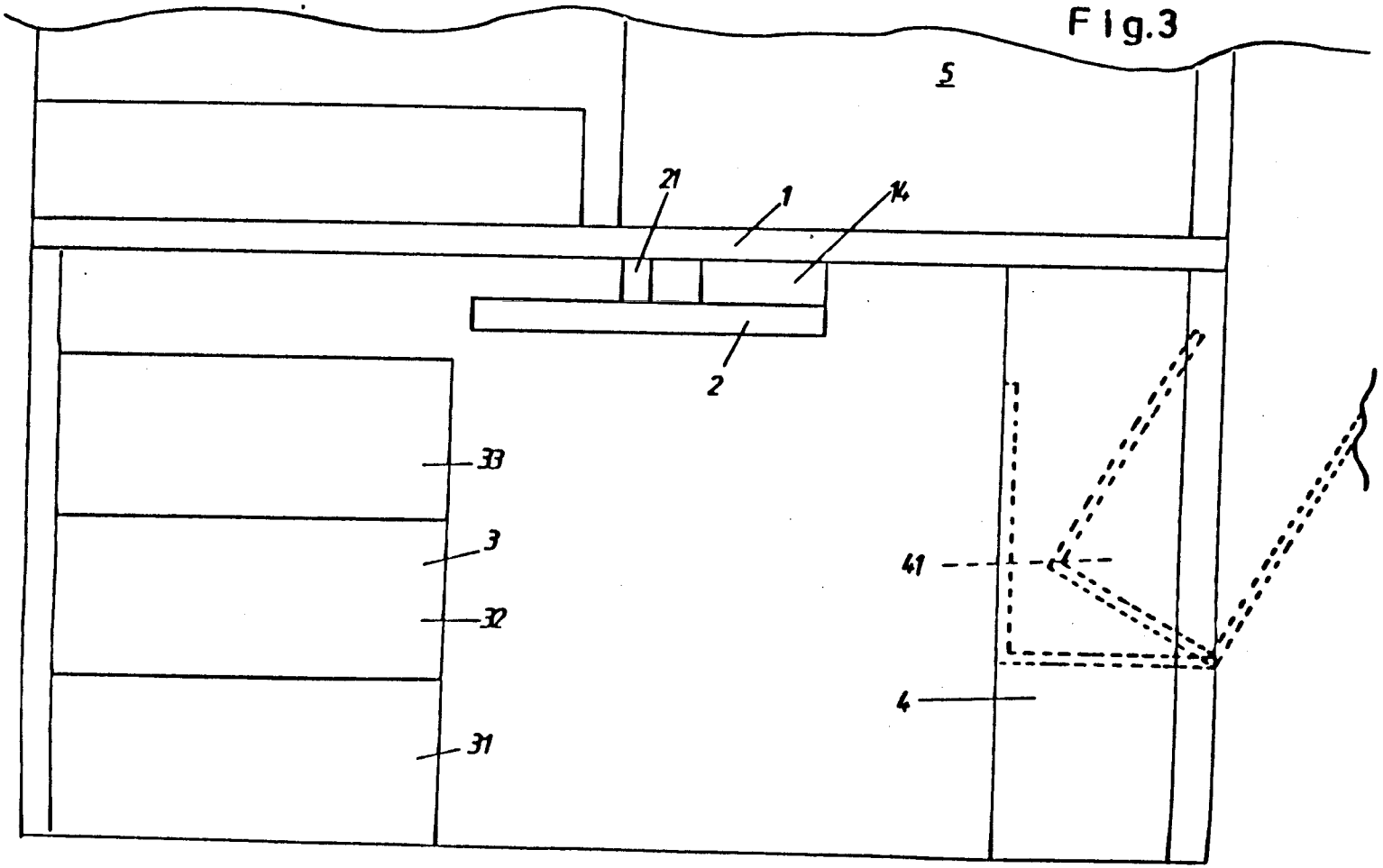
FIG. 3 is a side view of the oral hygiene work station shown in FIG. 2.

The oral hygiene work station to be placed against a wall includes a work table 1, a pivotal additional table top 2 disposed below the work table, cabinets 3 and 4 at each frontal face of work table 1, and a structure 5 mounted to the base and located above and at the rear of the work table 1.

A wash basin 11 equipped with a spray fitting 35 is integrated in work table 1. The wash basin is inserted in the region of the narrower base cabinet 4. In the embodiment, base cabinet 4 includes a container 41 which can be pivoted outwardly. Base cabinet 3 on the opposite side is seated on a base 31. This cabinet includes a drawer 32 as well as a panel 33. Drawer 32 and panel 33 serve to accommodate additional elements. For example, a video device can be accommodated behind panel 33. A periodontal spray is one of the additional elements which can be accommodated.

The additional table top 2 is pivotally fastened essentially in the center of the work table 1. The pivotal fastening is effected with the aid of a swivel joint 21 inserted at the underside of work table 1 and the upper sides of table top 2. In one end position, the table top 2 is pivoted between the work table 1 and the base cabinet 3. In the other end position, the table top 2 is pivoted out at a right angle to the width of the work table 1.

In the region disposed underneath work table 1 even if table top 2 is pivoted out, additional table top 2 has a portion 22 in the shape of a non-isosceles triangle. The side 23 of the triangular portion 22 facing front edge 12 of work table 1 when table top 2 is pivoted in, is longer than the side 24 which faces the rear edge 13 of work table 1 when the table top is pivoted in.

The portion of table top 2 projecting beyond work table 1 when table top 2 is in the pivoted-out state has the shape of a rectangle 25 with rounded corners. This configuration of additional table top 2, on the one hand, provides the largest possible work surface and, on the hand, permits pivoting of the table top 2 completely underneath the work table 1. A metal rail 14 is attached underneath the work table 1. In the pivoted-out state, the side 23 of the additional table top 2 is supported in this metal rail 14. In this way, the table top 2 is given additional stability.

The front edge 12 of the work table 1 in the region from its end closest to the base cabinet 3 to the location where the additional table top 2 begins to project in its pivoted-out position is essentially parallel to the straight rear edge 13. In the region of the pivoted-out additional table top 2, the front edge 12 is offset at an angle with respect to the rear edge 13. In the region between the end of pivoted-out additional table top 2 and the frontal face adjacent the wash basin 11, the front edge 12 converges toward the rear edge 13. This configuration results in a space saving configuration for the oral hygiene work station, but on the other hand provides sufficient room, for the patient as well as for the dental assistant and finally for the accommodation of necessary and additional elements.

The base-mounted structure 5 fastened to the rear of work table 1 is equipped with shelves 51 and with a mirror 52 next to them.

Swivel joint 21 is formed by a stepped pin 15 fastened to the work table 1 and a sleeve 26 fastened to the top 2 and coaxially enclosing a pin 15. The pin 15 and the sleeve 26 are supported so as to rotate in mutually opposite directions. Two pivot bearings are provided for rotatable support.

One of the pivot bearings is a ball bearing 61. The ball bearing 61 is adjacent table top 2. The other pivot bearing is an angular roller bearing 62. The angular roller bearing is placed remote from the table top 2.

A plate 16 is fastened to the lower free end of the pin 15. The plate 16 is screwed to the pin 15 with the aid of a cap nut 17. One part of the angular roller bearing 62 fastened to sleeve 26 is rotatably supported at the plate 16. The other part of the angular roller bearing is fastened to the pin 15 and supported at one of its steps. One part of the ball bearing 61 is also fastened to the pin 15 and supported at one of its steps. The other part of the ball bearing 61 is fastened to the sleeve 26.

The invention can be utilized commercially in the field of dentistry. The oral hygiene work station serves for patient education and prophylaxis. It can be used, for example, in dentists' offices.

We claim:

1. An oral hygiene work station for placement against a wall, comprising:

a work table having a frontal edge surface and a rear edge surface, and said work table including a wash basin and a spray fitting disposed therein;

at least one cabinet for accommodating additional elements, said cabinet having a base; and a table top pivotally mounted underneath and approximately in the center of said work table for pivotal movement between a first position wherein said table top is disposed between said work table and said cabinet such that said table top extends away from said wash basin and a second position approximately 90 degrees from said first position wherein said table top extends beyond said frontal edge surface of said work table and avoids interference with access to said cabinet.

2. An oral hygiene work station as defined in claim 1, further comprising a swivel joint for pivotally mounting said table top to said work table.

3. An oral hygiene work station as defined in claim 1, wherein said work table includes three regions, in the first region said frontal edge surface is parallel to said rear edge surface, in the second region at least a portion of said frontal edge surface is disposed at an angle to said rear edge surface, and in the third region, said frontal edge surface adjacent said wash basin extends toward said rear edge surface.

4. An oral hygiene work station as defined in claim 1, wherein said table top includes a generally rectangular region having rounded edges on the portion which extends beyond said frontal edge surface when said table top is disposed in said second position and a non-isosceles triangular region, said triangular region including a first side which is closer to said rear edge surface of said table top when said table top is in said first position and a second side which is closer to said frontal edge surface of said table top when said table top is in said first position, said second side of said triangular region being longer than said first side.

5. An oral hygiene work station as defined in claim 4, further comprising a metal rail attached below said work table, said metal rail supporting said table top when said table top is in said second position.

6. An oral hygiene work station as defined in claim 1, further comprising shelves and a mirror attached to said work table.

7. An oral hygiene work station as defined in claim 2, wherein said swivel joint includes:

a stepped pin attached to said work table; and a sleeve attached to said table top and being coaxially arranged around said pin, wherein said pin and said sleeve are supported for rotation in mutually opposite directions.

8. An oral hygiene work station as defined in claim 7, wherein said swivel joint further includes:

a ball bearing disposed between said pin and said sleeve and located near said work table; and an angular roller bearing disposed between said pin and said sleeve and located near said table top.

9. An oral hygiene work station as defined in claim 8, further comprising a plate attached to a free end of said pin and wherein said pin has a stepped profile such that one part of said angular roller bearing is supported by a step of said pin and another part of said angular roller bearing is supported by said plate.

10. An oral hygiene work station as defined in claim 8, wherein said pin has a stepped profile and one part of said ball bearing is attached to said pin and supported by a step of said pin and another part of said ball bearing is attached to said sleeve.

11. An oral hygiene work station as defined in claim 2, wherein said work table includes three regions, in the first region said frontal edge surface is parallel to said rear edge surface, in the second region at least a portion of said frontal edge surface is disposed at an angle to said rear edge surface, and in the third region, said frontal edge surface adjacent said wash basin extends toward said rear edge surface.

12. An oral hygiene work station as defined in claim 2, wherein said table top includes a generally rectangular region having rounded edges on the portion which extends beyond said front edge surface when said table top is disposed in said second position and a non-isosceles triangular region, said triangular region including a first side which is closer to said rear edge surface of said table top when said table top is in said first position and a second side which is closer to said front edge surface of said table top when said table top is in said first position, said second side of said triangular region being longer than said first side.

13. An oral hygiene work station as defined in claim 2, further comprising shelves and a mirror attached to said work table.

* * * * *